US005318164A

United States Patent [19]

Barnes et al.

[11] Patent Number: 5,318,164

[45] Date of Patent: Jun. 7, 1994

[54] VENDING MACHINE APPARATUS AND METHOD TO PREVENT FRAUD AND MINIMIZE DAMAGE FROM INJECTED FLUIDS

[75] Inventors: Thomas E. Shuren, West Chester; David C. Deaville, West Chester, all of Pa.; Michael Chittleborough, Binfield, England

[73] Assignee: Mars Incorporated, McLean, Va.

[21] Appl. No.: 883,788

[22] Filed: May 15, 1992

[51] Int. Cl.[5] ..... G07F 1/04; G07F 7/04; G07F 9/02

[52] U.S. Cl. ..... 194/200; 194/206; 194/348

[58] Field of Search ..... 194/200, 202, 204, 206, 194/207, 348

[56] References Cited

U.S. PATENT DOCUMENTS

| | | | |
|---|---|---|---|
| 2,006,433 | 7/1935 | Bierstedt et al. . | |
| 2,865,561 | 12/1958 | Rosapepe . | |
| 2,893,531 | 7/1959 | Hebel | 194/204 |
| 3,482,110 | 12/1969 | Robinson | 194/204 X |
| 3,917,260 | 11/1975 | Okkonen et al. | 194/206 X |
| 4,062,435 | 12/1977 | Chalabian . | |
| 4,080,598 | 3/1978 | Cordone | 194/204 X |
| 4,230,213 | 10/1980 | Spring | 194/348 |
| 4,264,000 | 4/1991 | Burton . | |
| 4,306,644 | 12/1981 | Rockola et al. . | |
| 4,346,798 | 8/1982 | Agey, III | 194/348 |
| 4,470,496 | 9/1984 | Steiner | 194/200 |
| 4,503,963 | 3/1985 | Steiner | 194/200 |
| 5,027,937 | 7/1991 | Parish et al. | 194/348 |
| 5,156,250 | 10/1992 | Parish et al. | 194/348 |

FOREIGN PATENT DOCUMENTS

| | | | |
|---|---|---|---|
| 1219587 | 9/1989 | Japan | 194/202 |
| 1250189 | 11/1989 | Japan | 194/348 |
| 1276293 | 11/1989 | Japan | 194/200 |
| 1306982 | 12/1989 | Japan . | |
| 2118795 | 5/1990 | Japan | 194/348 |

*Primary Examiner*—F. J. Bartuska
*Attorney, Agent, or Firm*—Davis Hoxie Faithfull & Hapgood

[57] ABSTRACT

An apparatus and method for reducing vandalism and minimizing damage from liquids injected into apertures of a vending machine is described. An anti-salting module, having a housing with an integral tray for collecting liquids, is connected beneath a bill validator in a vending machine A rubber fillet is connected to the rear of the bill validator and directs injected fluids to the tray. A moisture sensor integral to the tray is connected to detection and control circuitry. When moisture is detected, the detection and control circuitry operates to interrupt power and control signals to the bill validator. Other external sensors, such as a second moisture sensor and a continuity sensor for monitoring the status of other vending machine components, may also be connected to the detection and control circuitry. After moisture has been detected, vending machine power and control signals can be restored only when moisture is no longer present, and a SET switch is depressed by service personnel.

38 Claims, 8 Drawing Sheets

VENDING MACHINE APPARATUS AND METHOD TO PREVENT FRAUD AND MINIMIZE DAMAGE FROM INJECTED FLUIDS

FIELD OF THE INVENTION

The present invention relates generally to an apparatus and method for reducing vandalism and minimizing damage to a vending machine from injected fluids. This invention is concerned with means for increasing the ability of vending machine components, specifically bill validators, to handle an increased volume of injected fluids.

BACKGROUND OF THE INVENTION

Vandals force fluids into the bill entryway of bill validators in an attempt to generate false vending signals in vending machines to obtain free product and coins. Because of a method used by vandals to perpetrate the fraud, those familiar with the vending machine industry call this fraud practice "salting". Certain vending machine types, such as can and bottle machines, are particularly susceptible to such vandalism because they are frequently placed in exposed and unprotected locations. Thefts of up to 100 cans of soda and loss of coins from the coin tubes have been reported in some locations. Further, the cost for cleaning up bill validators, coin mechanisms, and other related vending machine components after such an attack can easily exceed three hundred dollars.

The liquids injected into a vending machine opening can cause extensive damage to the component associated with that opening. In addition, the liquids may drip into other machine components and cause direct or indirect damage, increasing the cost of repair.

Attempts have been made to design an apparatus to reduce the damage from such salting attacks. For example, a rainwater/anti-salting shield for installation in vending machines was made to reduce the ingress of liquids along the coin path. Such shields are frequently swamped by the volume of the injected fluids during a salting attack, and provide no protection for a bill validator.

One company, EIC of Jenison, Mich., manufactures a "Protection Unit" for bill validators which mounts inside the bill validator on the line side of a power transformer, and includes a moisture sensor that mounts in the entrance of the bill validator. The moisture sensor circuitry operates to remove power to the validator and to provide an alarm function when liquids are sensed. However, the bill validator must be disassembled for installation of the unit, and when moisture is sensed the vend line is not disconnected. Further, the unit does little to reduce the collateral damage produced by a salting attack. In addition, the moisture sensor of this unit is potentially exposed to tampering. Yet further, cleanup requires access to the moisture sensor.

The Mid-South Services Company of Dallas, Tex. produces the "Vender Defender", which is a shield-type device for limiting the amount of fluid injected, into the entrance of a bill validator. This unit does nothing to remove power or provide other protection in the case of a salting attack.

Other means, such as using slow blow fuses and ground fault interrupters, have been implemented to protect vending machines and their components from salting attacks. While these methods provide some protection, they tend to act only after damage has been done to a vending machine component such as the bill validator.

SUMMARY OF THE INVENTION

The anti-salting module of the present invention provides protection to bill validators and other vending machine components from insertion of conductive fluids into vending machine apertures. The anti-salting module consists of two parts, the first is the module itself which includes a T-cable for electronic connection, and the second is a rubber fillet which fits in the rear of the bill validator beneath a bill stacker. The fillet is designed to reduce the amount of liquids retained by the bill validator, and acts to direct injected fluids toward a moisture sensor in the anti-salting module to make detection easier.

The anti-salting module is mounted external to the bill validator without the need to use additional hardware or to modify the bill validator. The module contains tabs or fingers and clips which connect to existing openings located beneath the bill validator. The anti-salting module can be attached to the bill validator without using any tools, and remains in place under the influence of gravity. A T-cable electronically connects the module to the ends of the cables from the bill validator and the coin mechanism.

The anti-salting module has an integral tray to collect injected fluids and to direct them towards a drain. The drain accepts 1 inch diameter tubing which can be used to direct the injected liquid away from the vending machine components. An integral moisture sensor is located in the tray, and detection and control electronics are connected to the sensor. Other moisture sensors may be located in other parts of the vending machine and connect to the detection and control electronics of the module. Further, a continuity sensor and associated detection circuitry may be used to monitor status of other vending machine components. In addition, a set of alarm contacts are available to the vending machine owner which can be used to sound an alarm or siren, disable the machine dispensers, or turn off the vending machine entirely.

When moisture is detected, AC power, vend and control signals from the coin mechanism or control system are interrupted to the bill validator by the anti-salting module. Thus, damage is reduced and false vends are prevented. The power and control signals to the bill validator are latched in an open state until moisture is removed and a SET switch is depressed. The SET switch is mounted in the anti-salting module, and can only be accessed by service personnel.

After a salting attack, the tray of the anti-salting module must be cleaned before the bill validator can be repowered. An LED in the module, which lights when moisture is detected by the moisture sensor, aids in this cleaning operation. Once this LED is no longer on, then the unit can be returned to service by depressing the SET switch.

DETAILED DESCRIPTION

Figure 1:
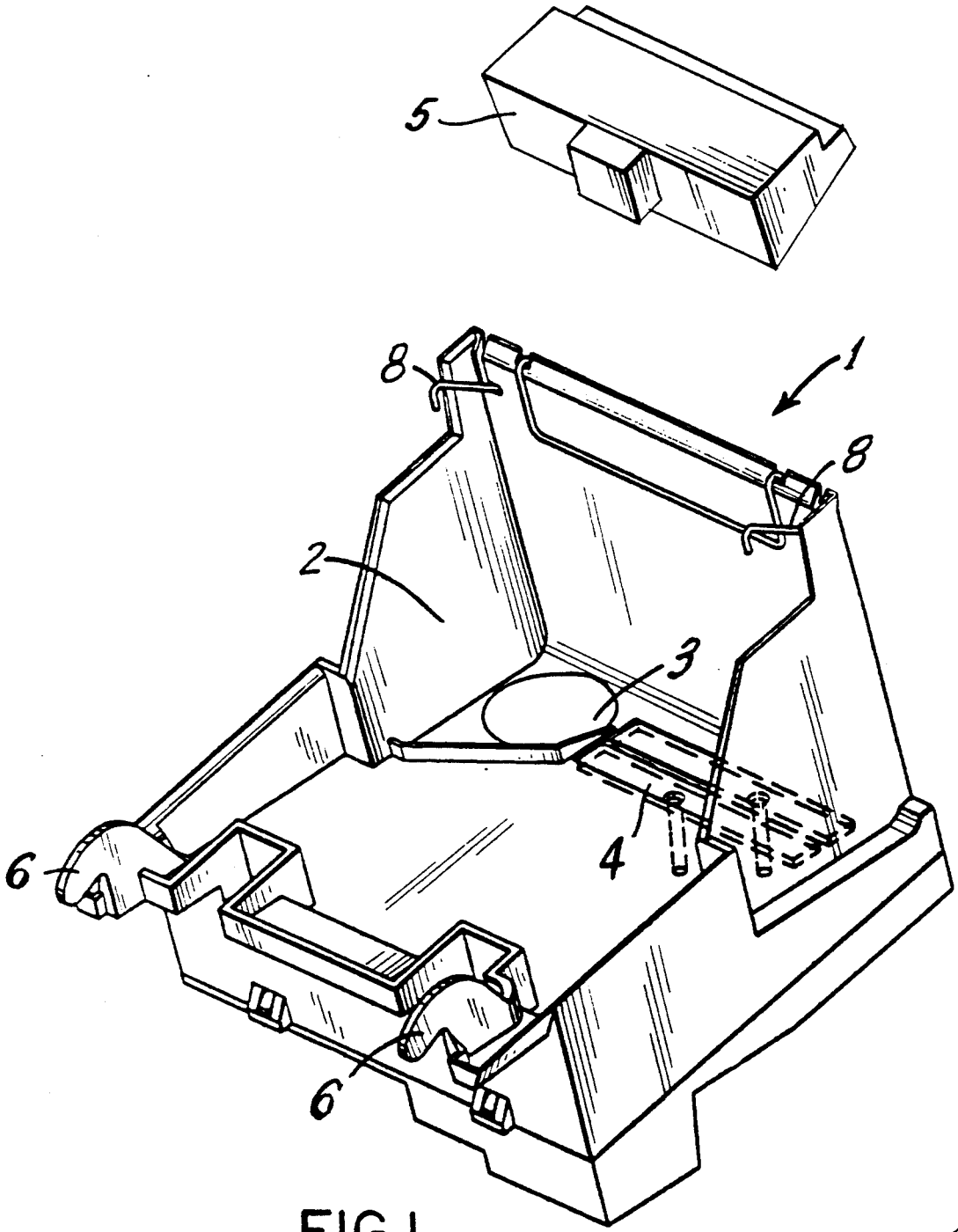
FIG. 1 is a three dimensional top and side view of an embodiment of the anti-salting module 1 and fillet 5 according to the present invention.

FIG. 1 depicts an embodiment of the anti-salting module 1 and fillet 5 of the present invention. This embodiment is designed for use with a Mars Electronics International model VFM1 and VFM3 bill validator. It should be understood that other embodiments would be required for other models and for attachment to bill validators manufactured by other companies.

Referring to FIG. 1, the anti-salting module 1 has a receptacle, cup or tray 2 for collecting fluids. The tray 2 is an integral portion of the module 1 and is formed into this shape when the plastic body which constitutes the module 1 is molded. The tray 2 contains a drain 3 and an integral moisture sensor 4, and is shaped so that fluids that would normally drip onto various vending machine components mounted beneath the bill validator, such as the coin mechanism, cash box, and vend switches, are directed over the moisture sensor 4 and to the drain 3. The moisture sensor 4 is comprised of two conductive strips or electrodes mounted into depressions in the tray 2. Detector circuitry (not shown) senses a change in resistance across the narrow portion of plastic between the electrodes when a conductive fluid is introduced. Thus, when a conductive fluid or moisture is detected in the tray 2, the detector circuitry acts to disconnect power and control signals as described below.

Figure 2:
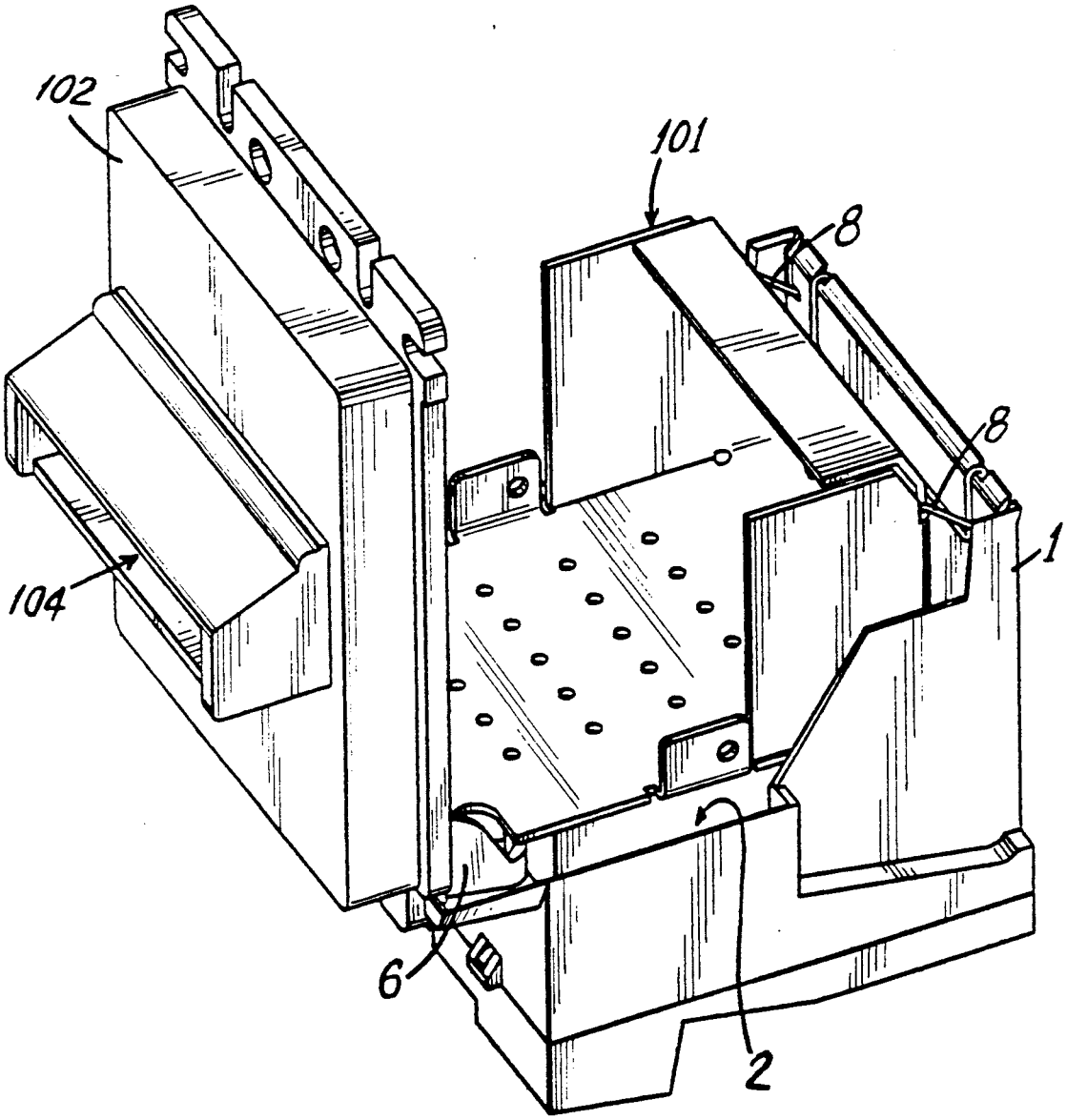
FIG. 2 is a three dimensional top and side view of the anti-salting module of FIG. 1 connected to a cutaway portion of a bill validator.
Figure 3:
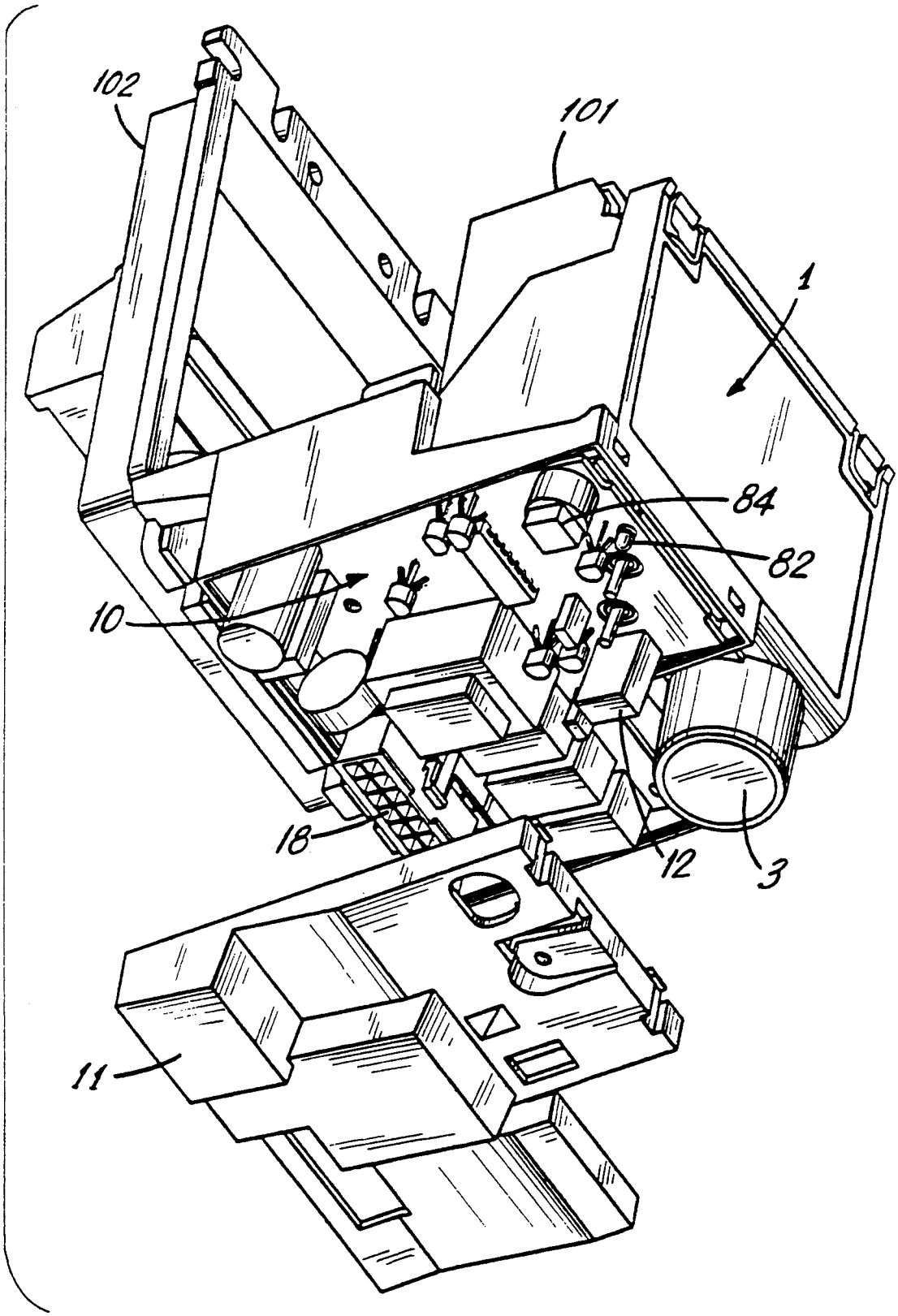
FIG. 3 is a partially exploded three dimensional side and bottom view of FIG. 2.
Figure 4:
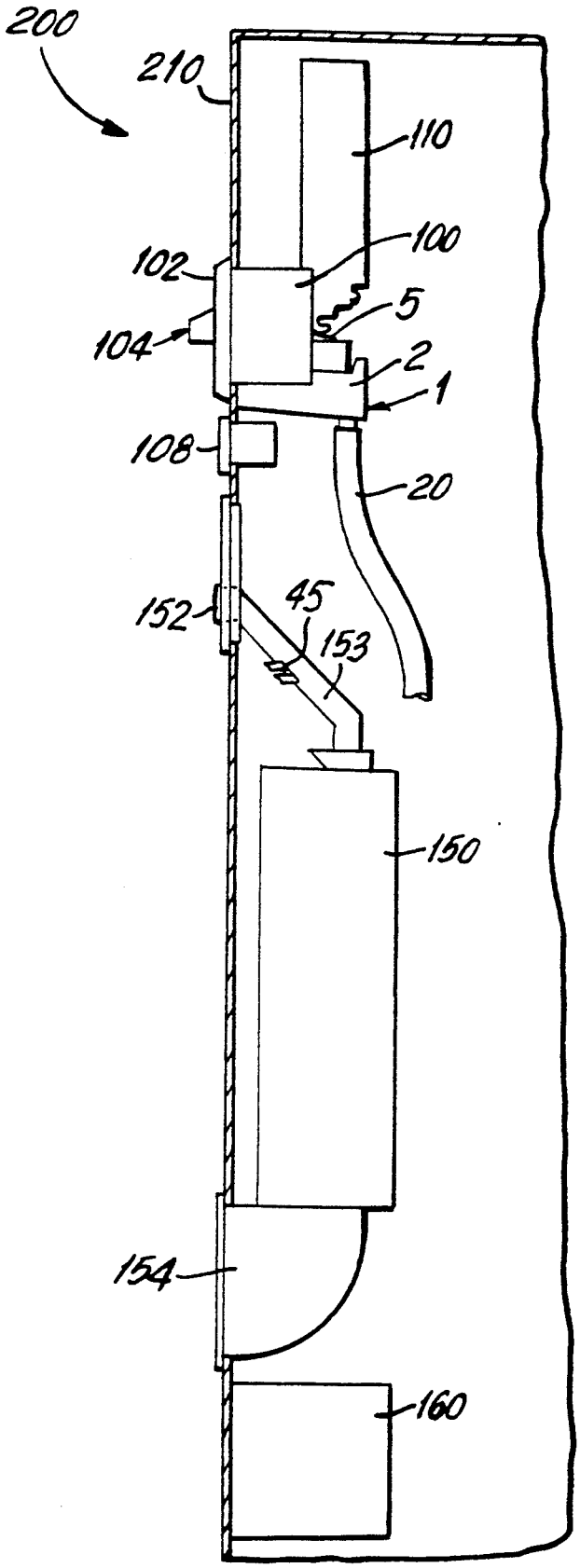
FIG. 4 is a partial cutaway side view, not drawn to scale, of various vending machine components and the present invention.

The anti-salting module 1 has extensions or fingers 6 which are designed to slip into vertical openings between the mounting bezel and the body of a bill validator (shown in FIGS. 2, 3 and 4). Shaped wire clips 8, mounted to the rear of the module 1, are designed to slip into existing openings in the rear of the bill validator. When connected, the anti-salting module 1 is secured to the bottom of a bill validator under the influence of gravity.

The fillet 5 is a molded piece of rubber designed to fit into the rear of the bill validator beneath a bill stacker. The fillet 5 directs injected fluids into the tray 2, and is discussed below with reference to FIG. 4.

The details regarding the operation of bill validators, coin mechanisms and other vending machine mechanisms or control circuitry are not part of the present invention and will not be described in detail. However, the present invention physically and electronically attaches to a bill validator of a vending machine, and therefore some details regarding vending machine operation are discussed below.

FIG. 2 depicts the anti-salting module 1 attached to a partial bill validator assembly 101. A face plate or bezel 102 has a bill opening 104 through which conductive fluids are injected by vandals. (Like components are numbered the same in the figures.) Various bill validator mechanisms, such as the bill transport and validation system, have been removed to show the various openings through which fluids would flow into the tray 2, and to illustrate how the anti-salting module 1 is connected. As shown, fingers 6 and wire clips 8 attach to existing openings of the assembly 101.

FIG. 3 depicts the assembly of FIG. 2 rotated 90 degrees to show the underside of the anti-salting module 1. An electronics compartment 10 having a cover 11 is shown. The electronics compartment 10 holds the moisture detection and control circuitry in an enclosed area located below the tray 2. A moisture present LED 82 and a SET switch 84 are also shown, and are discussed in detail below. The drain 3 can accept one inch diameter flexible tubing to allow collected liquids to be piped into an area where they will do no harm. Also depicted in FIG. 3 are a 4-pin connector 12, and a 14-pin connector 18, which are discussed below.

FIG. 4 is a partial cutaway side view, not drawn to scale, of a vending machine 200 showing a typical component layout along the vending machine front panel 210. FIG. 4 also shows the anti-salting module 1 and fillet 5 connected to the bill validator 100. The anti-salting module 1 and fillet 5 can be fitted to existing bill validators without the use of additional hardware, and without modifying or removing the existing validator from the front panel 210. The front panel 210 contains bill validator bezel 102, a bill opening 104, exact change light 108, coin slot 152 and coin return chute 154, which are accessible to customers of the vending machine. The module 1 mounts directly beneath the bill validator 100 inside the vending machine 200, and is accessible only to service personnel, not to customers using the vending machine. Plastic tubing 20 is connected to the module 1, and is used to drain fluids collected in the tray 2 away from the vending machine components to a bucket or some other drainage means (not shown). The tubing 20 could be made of rubber, plastic or other materials and comprise tubing, pipe or any other type of conduit for channeling the liquid. A coin mechanism 150 is also shown having a coin slot 152, coin track 153 and a coin return chute 154, and is mounted above the cash box 160. An external moisture sensor 45 can be placed in the coin track 153, and is electronically connected to the detection circuitry of the module 1, as explained below.

The fillet 5 of the present invention is inserted into the rear of the bill validator 100 under the bill stacker 110, as shown, to block fluid from flowing into the validator. The fillet 5 also directs fluids into the tray 2 to trigger the moisture sensor 4, and for draining liquid away from other sensitive circuitry.

Figure 5:
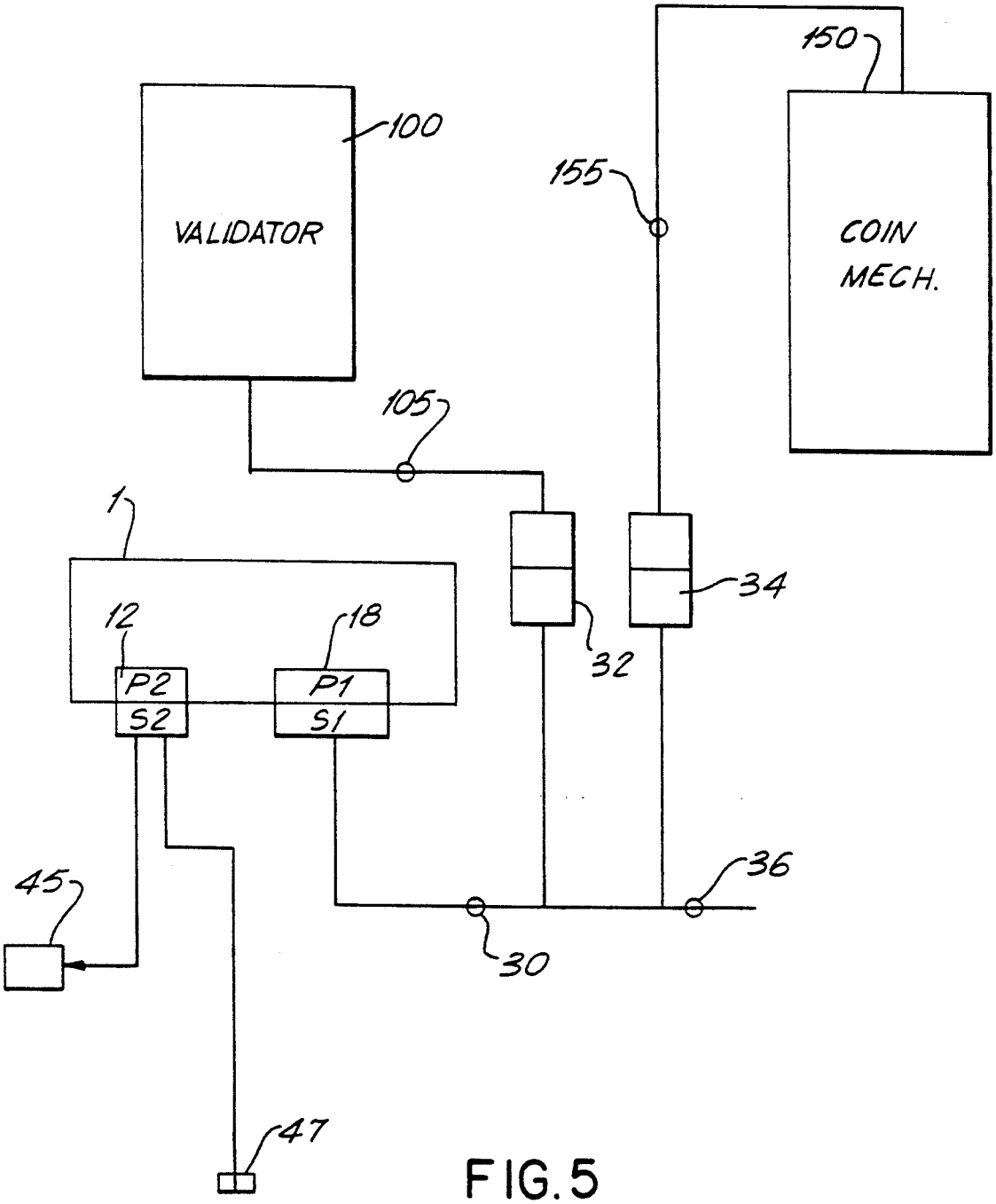
FIG. 5 is a simplified block diagram illustrating the electrical connections of an anti-salting module according to the present invention.

FIG. 5 is a simplified block diagram showing the electrical connections of the anti-salting module 1 depicted in FIG. 4. The module 1 is connected via a T-cable 30 and two 9-pin connectors 32, 34 to the bill validator 100 and the coin mechanism 150. The coin mechanism 150 is normally connected directly to the bill validator 100, via cables 105 and 155, to provide power to the validator and to permit the exchange of signals. As shown, the bill validator 100 and coin mechanism 150 plug directly into the anti-salting module 1. A power supply is integral to the anti-salting module 1 and is powered from AC power obtained from the coin mechanism cable 155.

The electronic control circuitry for the anti-salting module is mounted in an electronics compartment 10 (shown in FIG. 3) located beneath the tray 2. Both strips of metal which comprise the moisture sensor 4 are connected to a PC board (shown in FIG. 3) by a screw or stud (not shown) which passes vertically through the floor of the tray 2 and into the electronics compartment 10. The bottom of the tray 2 remains sealed. Thus, the PC board and electronic circuitry in the electronics compartment 10 of the anti-salting module 1 are protected from liquids (See FIGS. 1 and 3). A 14-pin connector 18 allows for connections of the T-cable 30 to both the coin mechanism 150 and the bill validator 100 of FIGS. 4 and 5. A 4-pin connector 12 allows other functions to be added to the vending machine 200 for added protection. For example, another moisture sensor 45 could be added elsewhere in the machine, or a continuity sensor 47 could be added to detect if any components, panels, or assemblies in the vending machine 200 were moved or damaged in any way.

Figure 6:
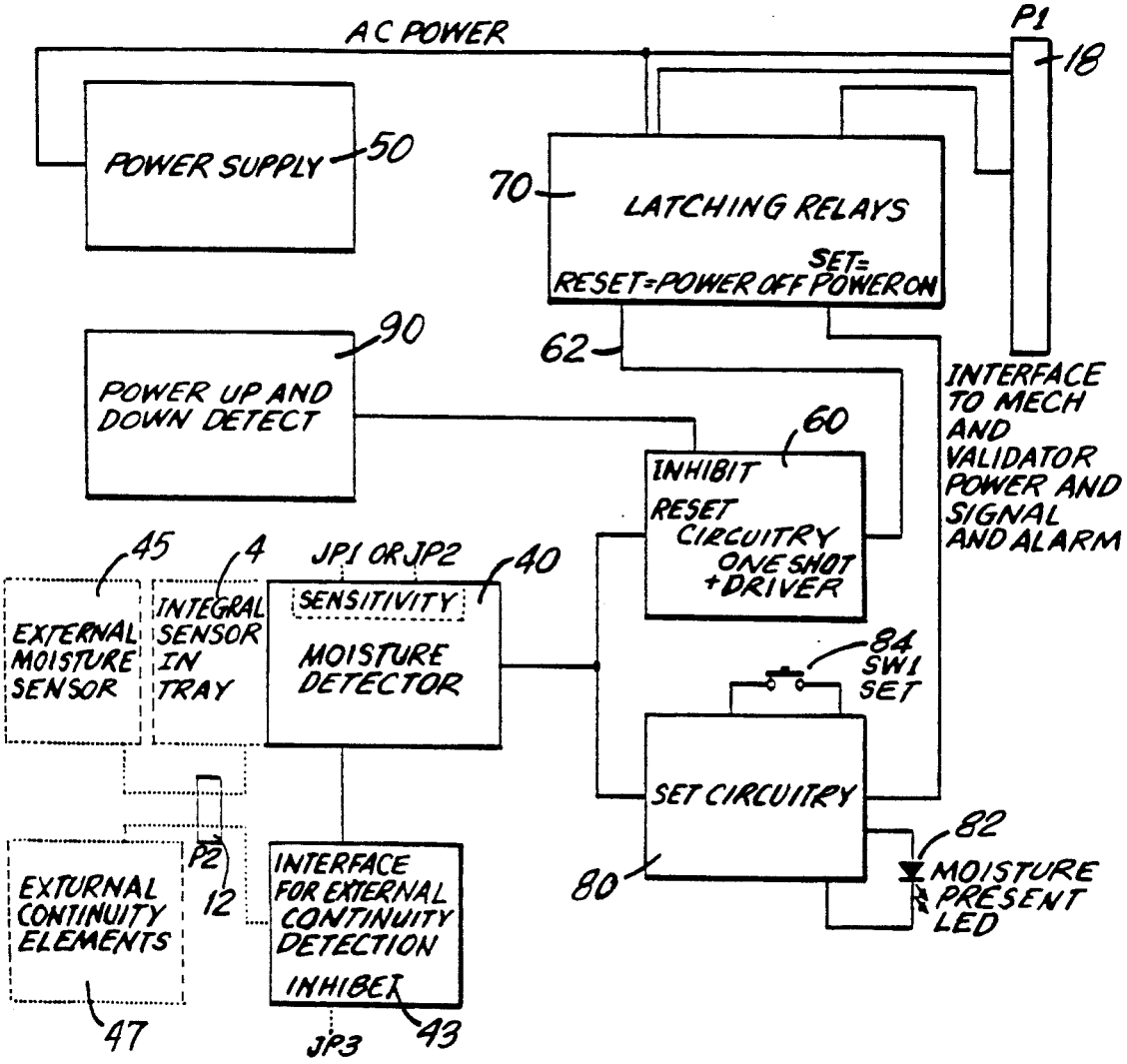
FIG. 6 is a simplified block diagram showing an embodiment of the circuitry associated with the present invention.

FIG. 6 is a block diagram of an embodiment of the circuitry of the anti-salting module 1. A power supply 50 supplies 12 volts of power through a transformer (shown in FIG. 7A), and isolates the electronics from AC power so that power leakage will not occur in the presence of liquids. A moisture detector 40 is connected to the electrodes of the moisture sensor 4 mounted in the bottom of the tray 2. The output of the moisture detector 40 goes high if moisture or a conductive liquid is sensed. An external moisture sensor 45 can also be connected to the moisture detector 40 to monitor for moisture in another part of the vending machine. A continuity alarm 43 can also activate the moisture detector 40 if an external continuity device 47 in the vending machine 200 senses a change in state of another part of the vending machine, such as damage to a front door assembly. This can be used to ensure integrity of other vending machine functions that may suffer from tampering.

Reset circuitry 60 accepts the output of the moisture detector 40 and generates a single 20 ms or greater pulse when this level goes from a low, approximately one volt or lower, to high, typically 10 volts or higher. This pulse is delivered via line 62 to the reset coils of three latching relays (shown in FIG. 7A) in latching relays block 70, whose set and reset coils are connected in parallel. Each relay will latch in one position and remain there even in the absence of power, remembering the state into which they were last driven. When moisture is detected the reset coils of the latching relays are powered momentarily, latching them in the reset position. Five of six sets of latching relay contacts are used to remove AC power and control lines from the validator. The sixth set of contacts can be used to inhibit machine operation, to disable the coin mechanism from paying out coins, to operate an alarm or timed siren, to remove power from the entire vending machine, or a combination of these. The latched unpowered state can render the entire machine inoperable. This allows the operator to become aware of the contaminated state of the machine and initiate remedial action so as to reduce the corrosion to the bill validator, coin mechanism and the vending machine.

When power is removed from the bill validator 100 due to moisture, the alarm contacts of the relays are set in the active position. This is called the reset or unpowered state. This is particularly important since having AC power connected to the bill validator in the presence of a conducting liquid is very destructive. Shorts and conduction paths are created both across the AC line and to low voltage circuitry which may cause extensive damage and makes repair very difficult. Removal of power prevents the bill acceptor motor from running and spreading the conductive liquid up into the electronics and bill stacker assembly. Further, the vend relay line is broken (opened by a latching relay), so that no spurious bend pulses can be generated by the bill validator. Thus, the cause of multiple phantom vends are removed which normally result in coins and product being paid out by the vending machine during a salting attack. Additionally, two AC line related signals associated with enabling and inhibiting are required to support some bill validator interfaces. These lines are also opened by use of a latching relay. All of these lines, five in number, are broken and then latched in the open state (no AC power, no vend, no control lines) so that removal of AC line power from the vending machine at the wall outlet, and then reapplication of AC line power, cannot cause these contacts to be closed and return the validator to operation. This prevents later damage to the bill validator, perhaps during service and cleanup, as well as preventing the vandal from re-powering the vending machine to obtain product or money.

The output of the moisture detector 40 also drives the Set block 80. The Set block 80 turns on a moisture present LED 82 when moisture is detected. In addition, it provides the output pulse to drive the set coils of latching relays into the Set or Operate condition when a Set switch 84 is depressed. This pushbutton is integral to the module. When the SET switch 84 is depressed, the contacts of the relays in the unit move to their set position and return normal functionality to the validator only if the moisture detector determines that moisture is no longer present. This ensures that the affected unit is serviced and not just repowered. This can result in a timely repair which will reduce damage to the unit. The moisture present LED 82 aids the service technician in the cleaning of the unit.

Power Up/Down detect circuitry 90 inhibits the Reset circuitry 60 so that the status of the latching relays does not change when AC power is applied or removed from the bill validator, or from the vending machine. This prevents false triggering of the reset coils of the latching relays when Ac power is changing.

MOISTURE DETECTION

Moisture is detected when fluids connect the two electrodes of the moisture sensor 4 which changes the resistance across the electrodes. This occurs because the resistivity value of water and other fluids is much smaller than that of the plastic insulation and air that separates the two electrodes.

An embodiment of the moisture sensor 4 of the present invention comprises two metal electrodes, each 54 mm long, separated by about 2 mm of the plastic tray material. The plastic has a bulk resistivity of approximately 1.4 to $1.5\times10^{14}$ ohm/cm. Thus, the resistance across the electrodes without any liquid present is about $4\times10^{11}$ ohms. So, with a 2 mm separation and a 1 mm conduction path for the liquids, the resistance R is approximately as follows:

$R=4\times10^{11}$ ohms for no liquid;

$R=2\times10^{4}$ ohms for ordinary water; and $R=2\times10^{3}$ ohms for sea water.

In practice, although some leakage through the electrodes occurs, the conduction path for liquids is wider, resulting in even lower resistance values across the electrodes when a liquid is present. Consequently, the presence of liquids produces a dramatic change in resistivity which is easily sensed.

CIRCUIT DESCRIPTION

Figure 7A:
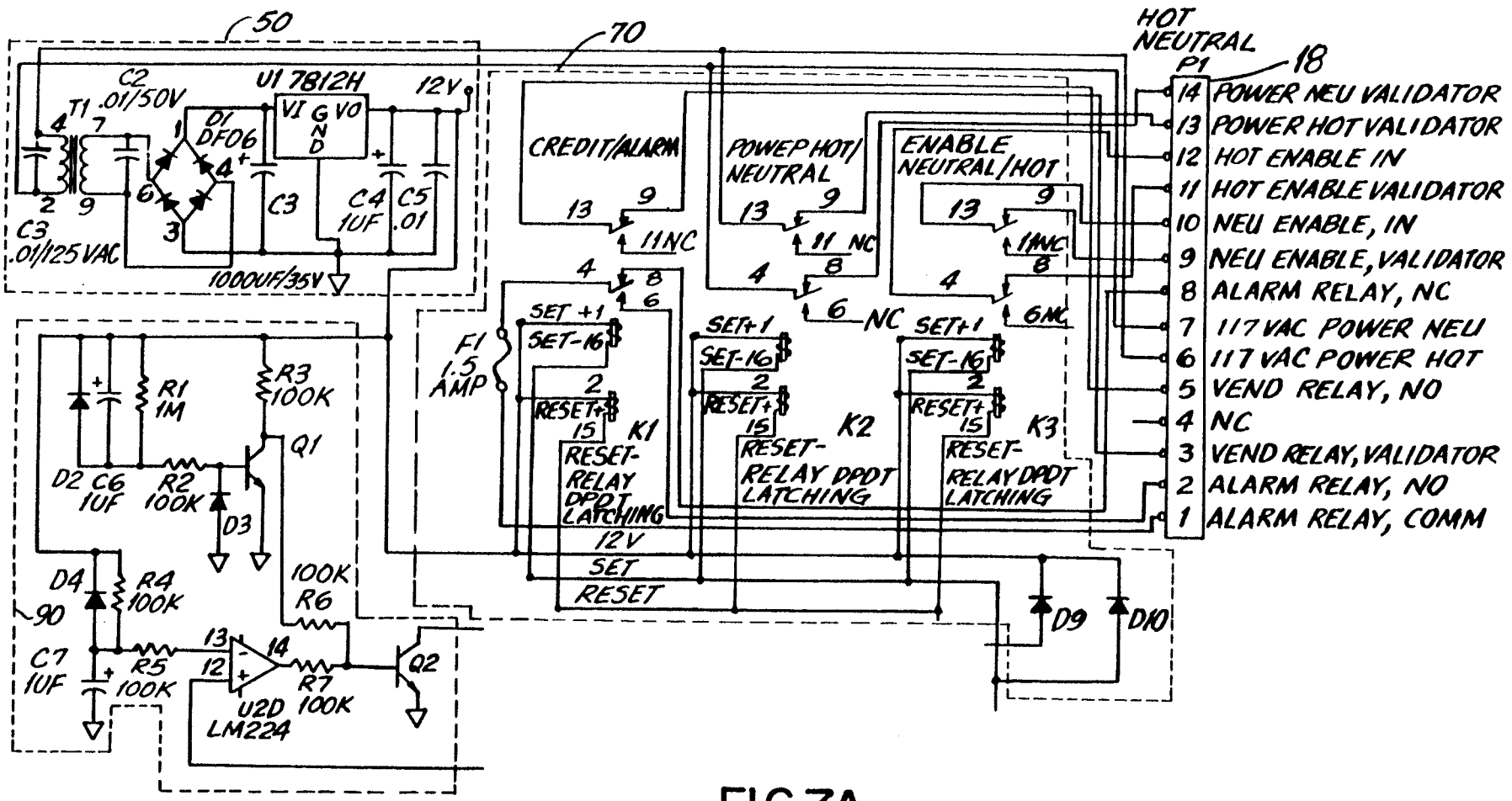
FIGS. 7A and 7B together depict an embodiment of the circuits comprising the detection and control circuitry associated with the present invention.
Figure 7B:
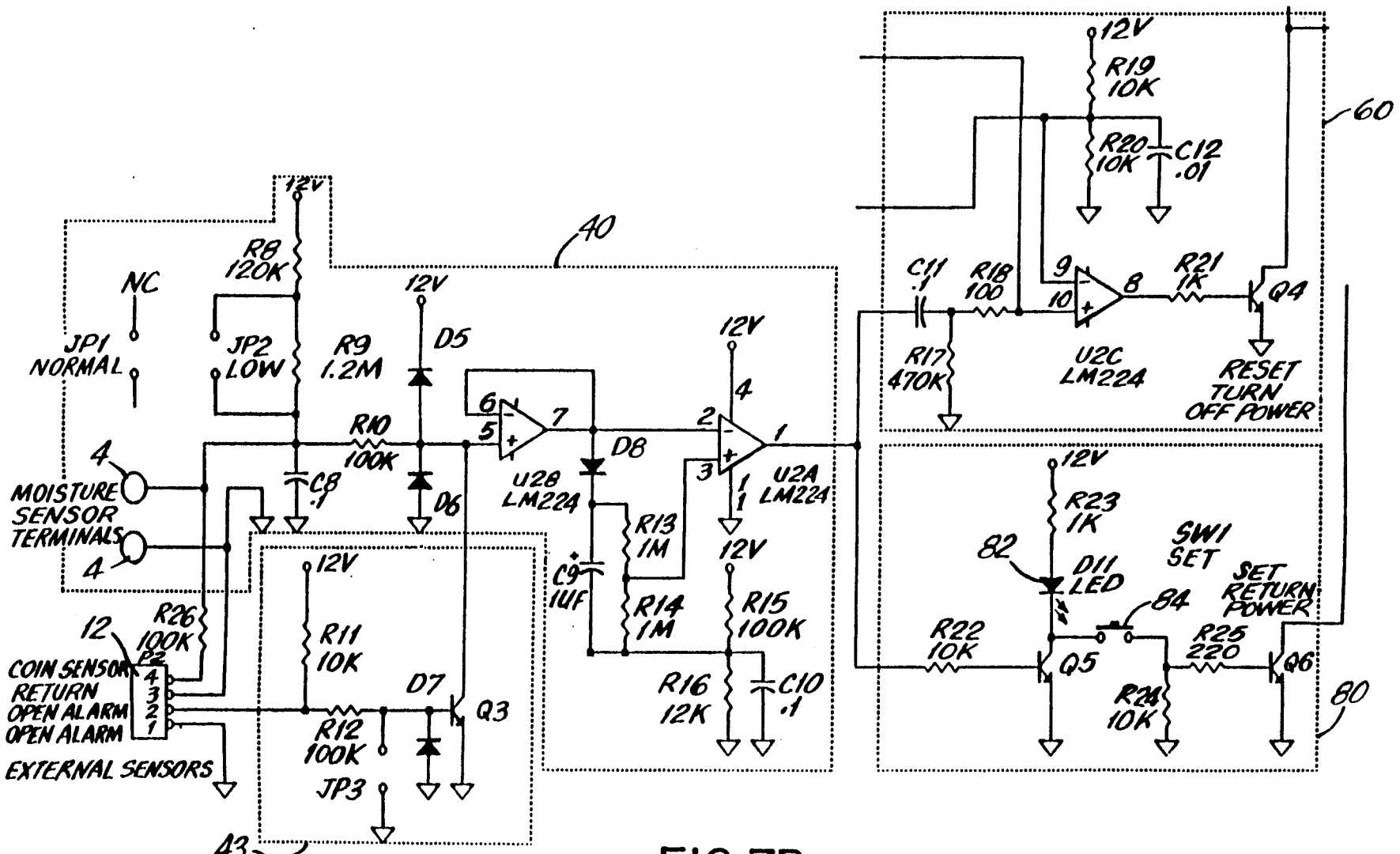

FIGS. 7A and 7B depict an embodiment of the moisture detection and control circuitry of the present invention. Referring to FIG. 7A, the power supply circuitry 50 receives 117VAC power from the coin mechanism 150 via the T-cable 30 which is plugged into the 14-pin connector 18 or P1 on the PC board. AC power enters on pins 6 and 7 of P1 and is used to drive the input side of transformer T1. AC power leaves P1 via pins 13 and 14 to the bill validator 100 if the relay K2 is in its normal set position. Transformer T1 steps down the AC line voltage and isolates the circuitry from the AC line. The AC voltage at the secondary of T1 is rectified by the diode bridge D1. Capacitor C3 filters the pulsating DC appearing at the input of the voltage regulator U1. Capacitors C1 and C2, located on the primary and secondary sides of T1, are used to lower line noise. Capacitors C4 and C5 provide filtering of the output of the 12 V linear voltage regulator U1.

For purposes of the following discussion, the range sensitivity jumper, shown in FIG. 7B, is in the normal (JP1) position and jumper JP3 is in place. Thus, the moisture detection and control circuitry is set to function with normal sensitivity and without a continuity sensor. The function of jumpers JP1, JP2 and JP3 is discussed in detail below.

The moisture detector circuitry 40 uses two sections of a quad LM224 operational amplifier integrated circuit, U2B and U2A. U2B is used as a high impedance voltage follower while U2A is used as a comparator. One of the terminals of the moisture sensor electrodes 4, which is integral to the tray 2, is connected at the junction of resistors R9 and R10. The second terminal of the integral moisture sensor 4 is connected to ground. Thus the moisture detector forms a voltage divider as a third resistor to ground which is in series with R8 and R9. This is the point that is presented to the noninverting input of U2B via resistor R10. If there is no moisture present across the terminals of the electrodes in the tray 2, the resistance across these terminals will be many megohms in value. This may range from 10 to many hundreds of megohms. This is a measurement of the leakage of the plastic which is used to mount and separate the moisture sensor electrodes. The input impedance of the voltage follower U2B will be 40 megohms or greater. Thus, the voltage at the junction of R9 and R10 will be an appreciable fraction of the 12 volt supply, since the impedance at the top of capacitor C8 looking up towards the 12 volt supply is only 1.32 megohms while that looking down towards ground will be many megohms. If the resistance of the sensor in parallel with the input impedance of U2B is 11 times that of the sum of R8 and R9, then the resistance is approximately 14.5 megohms. This means that the voltage at C8 will be about 11 volts. Since very little current flows into the noninverting input of U2B, then the voltage at the noninverting input (pin 5) will be nearly 11 volts as well.

Since U2B is a voltage follower, the output of U2B (pin 7), will equal its input or be 11 volts. Diode D8 will charge capacitor C9 until the voltage across D8 and C9 plus that at the junction of R15, R16 and C10 is equal to 11 volts. The voltage at the junction of resistors R15 and R16 is about 1.3 volts. Since after some initial charging, very little current flows through D8 (5 microamps through R13 and R14 plus a few microamps or less of leakage through C9) the voltage drop across this diode will be 0.5 volts or less. This means that capacitor C9 will have about 9.2 volts across it. The divider R13 and R14 will divide this in half so that the voltage at the noninverting input of the comparator U2A will be approximately 5.9 volts. Since the voltage at the inverting input of U2A is 11 volts, and the inverting input voltage is much greater than the noninverting input, the output of U2A will remain low.

If a conductive fluid is now placed across the terminals of the moisture sensor, the impedance across C8 will drop to less than 10K ohms. The exact amount the impedance drops depends upon various factors including how much liquid is present, how conductive it is, the area of the sensor involved, and the type and temperature of the liquid. Assuming that the resistance drops to 10 K ohms, since resistors R8 and R9 form a voltage divider with the sensor, the voltage across C8 will now be under 100 mv. Thus, the input of U2B will drop to under 100 mv, and the output of U2B will go to under 100 mv. Diode D8 prevents the charge on capacitor C9 from changing rapidly since now its only discharge path is through R13 and R14. Hence the noninverting input of U2A will remain at the same value as earlier, about 5.9 volts. Since the voltage at the inverting terminal is about 90 mv, the output of U2A will swing high, driving current into the base of transistor Q5 of set block 80 and causing collector current to flow to turn on the moisture present LED 82.

The positive going edge from U2A will also be coupled through capacitor C11 and resistor R17 of reset block 60 to ground. This differentiated signal from the output swing of U2A, approximately 10 V, will produce a spike of about the same size, but decreasing in time by the RC action of C11 and R17. A portion of this spike presented via resistor R18 of reset block 60 to the noninverting input of U2C will be greater than the voltage present at the inverting input, so the output of U2C will go high. As capacitor C11 charges, the voltage at pin 10 of U2C will drop below that at pin 9, and the output of U2C will go low again. For as long as the output of U2C is high, transistor Q4 will receive base drive and pull low the reset line of the three latching relays K1, K2 and K3 of FIG. 7A. Current flows through the reset coils of these devices, latching them in the reset position to remove power to the validator and to assert the alarm contacts that go to 14-pin connector 18 pins 1 and 2. In the reset circuitry 60, capacitor C12 provides a filter for the reference voltage at the junction of resistor R19 and R20, and resistor R18 at the noninverting input of U2C is used to suppress operation of the Reset circuitry during power up and down, which is described in detail below.

Referring to FIG. 7A, diode D9 in the latching relay block 70 limits the inductive kick from the coils when transistor Q4 in the reset block 60 turns off. It should be noted that no further signal is needed to keep the relays in the reset position to hold the validator unpowered, and that the relays retain this state even if 12 V power is removed.

Referring to FIG. 7B, the arrangement of diode D8, capacitor C9, resistors R13 and R14, and the comparator U2A in the moisture detection block 40, form an adaptive comparator that looks only for the signal to change to some fraction of a quiescent, prior value. With the values as shown in FIG. 7B, the threshold is such that the value of the signal must change to approximately 50% (ignoring the effect of R15 and R16) of its quiescent value. Thus, if leakages cause the output of U2B to rest at 8 volts, operation of the moisture detector circuitry is unimpaired when moisture is detected and the output of U2B changes to under 4 volts. If consideration is given to the presence of the bias network of R15 and R16, then the 8 volts signal at the output of U2A must change to below about 4.4 volts. The amount of change required can be controlled by changing the ratio of resistor R13 to R14. The addition of the bias network supplied by resistors R15 and R16 adds a low limit threshold that causes operation of the comparator U2A if the output of U2B drops below about 1.3 volts, independent of its prior state. These two techniques combat the problem of leakage through the moisture sensor, which may impair the correct operation of the moisture detector circuitry, that may occur with age, use and environment.

Sensitivity of operation of the detector circuitry may be changed by using a jumper across either JP1 or JP2. Thus, the sensitivity of the moisture sensor may be decreased to handle humid locations or situations. With a jumper across JP2, resistor R9 is shorted out and thus larger leakages can be handled across the moisture sensor elements without triggering the reset condition of the relays. Sensor resistance of 100K ohms or less can be accommodated without loss of functionality. The jumper plug is stored on the two pins associated with JP1 when it is not used at position JP2, and there is no ohmic connections to the pins of JP1.

An external moisture sensor (outside the tray) could be mounted at some other place in the vending machine, such as on or in or under the coin track that leads from the coin slot on the front of the machine to the coin cup at the entrance of the coin mechanism. The sensor could consist of two electrodes on an insulator, a piece of flexible PC board material, or contacts to two screw heads mounted on a plastic or insulating substrate. Fluid injected into the coin slot could thus be detected by the external sensor along this path which would trigger the moisture detector circuitry 40 and force the latching relays into their reset position. Thus, power would be removed from the bill validator and the set of alarm contacts (upper set of contacts of relay K1) would be moved to the active state, which could directly or indirectly remove power to the coin mechanism or the vending machine as well as activate an alarm or siren. Referring to the latching relays block 70, fuse Fl is used to limit current through the alarm contacts used by the owners to protect their vending machines.

Resistor R26 and capacitor C8 are connected to pin 4 of the 4-pin connector 12, and are used as a filter to reduce noise that might result from use of an external moisture sensor. Resistor R10 and diodes D5 and D6 protect the input of the voltage follower U2B, and capacitor C10 filters the voltage reference provided by resistors R15 and R16.

Referring to FIG. 7A, relays K1, K2 and K3 of latching relay block 70 remain latched in the reset position when tripped, removing power and signals from the validator until the set coils of the relays are activated. The relays can be set to return power and functionality to the bill validator only by depressing the SET pushbutton 84 in set circuitry 80 (see FIG. 7B) with no moisture present at the sensor. If moisture is present at the sensor, such that the output of U2B is less than the voltage at the junction of R15 and R16, then the output of U2A will remain high. This keeps transistor Q5 active and keeps the LED 82 illuminated to indicate that moisture is present. Hence, because the collector voltage of Q5 is low, depression of the SET switch 84 will not cause transistor Q6 to turn on to set relays K1, K2 and K3. The moisture sensor 4 must be cleaned and dried so that the output of U2A is low before setting of the latching relays can take place. The presence of the LED 82 provides a guide as to the effectiveness of the cleaning of the moisture sensor 4. When the LED 82 is off, this indicates that the output of U2A is now low and setting of the latching relays K1, K2 and K3 is possible.

When the LED 82 is no longer illuminated, the collector of Q5 is high. Thus, depression of the SET switch 84 now provides base drive to transistor Q6 via the path resistor R23, LED 82, and resistor R25. Transistor Q6 forces current through the set coils of the latching relays K1, K2 and K3, and moves them to the set position. This action returns power to the bill validator, connects signals to and from the bill validator to the rest of the vending machine, and moves the alarm contacts from their active to their passive position. Diode D10 at the collector of Q6 is used to suppress the turn off transient signal associated with these coils. Resistor R24 is used to lower the input impedance of the base of transistor Q6 when SET switch 84 is open so that noise cannot trigger transistor Q6 into conduction. When the moisture sensor is clean and the SET switch 84 is depressed, the LED 82 will illuminate for as long as the switch is depressed, indicating that setting of the latching relays is taking place.

During application and removal of AC power, information received from the integral moisture sensor and other sensors may not be reliable. To suppress these transient effects, the Reset circuitry 60 is inhibited during these times. To suppress undesirable behavior during the time when AC power has just been applied, power up detection circuitry 90 (see FIG. 7A) comprising U2D and its associated circuitry is used. When AC power is applied, capacitor C7 is discharged. When the voltage begins climbing from zero to 12 volts, capacitor C7 begins charging through R4 slowly. The voltage at the noninverting input of U2D is produced by resistors R19 and R20 along with capacitor C12 of Reset block 60, which climbs quickly because of the short time constant associate with these components. Since the voltage at the inverting input is less than the voltage at the noninverting input of U2D, the output of U2D goes high turning on the transistor Q2. When Q2 turns on, it forces the noninverting input of U2C of Reset block 60 to nearly ground. This effectively inhibits the functioning of the Reset circuitry 60. As C7 charges, its terminal voltage passes through the voltage level generated by R19 and R20, at which point the output of U2D goes to the normal low state. When this occurs, transistor Q2 is no longer conducting and normal operation of U2C is allowed. Diode D4 and resistor R4 act to discharge C7 when power is removed.

When AC power is removed, the power up detection circuitry 90 suppresses any operations during this time. Capacitor C6 is charged to about 10 volts at this time, and this charge cannot be changed instantaneously. Transistor Q1 is thus held on by current flowing through resistors R1 and R2. As the 12 volt supply begins to drop, the junction of C6, R1 and R2 is forced towards ground and finally lower than ground, so that transistor Q1 no longer receives base drive and turns off. The collector of Q1 goes high and acts as a source of current via R3 for resistor R6 to turn transistor Q2 on and thus to hold the reset circuitry 60 inoperative. Diode D2 and resistor R1 provide a discharge path for C6, as do resistor R2 and diode D3. The primary function of diode D3, however, is to protect the base of transistor Q1 from reverse voltage breakdown by the action of C6.

To allow for the inclusion of an open alarm where continuity is assumed normal and an open is abnormal, the continuity detection circuitry 43 of FIG. 7B is used. For example, a conductive foil strip might be attached to the rear of the Exact Change light to monitor its status. If the Exact Change light is disturbed, the conductive foil would be ruptured and cause an open circuit to occur. If jumper JP3 is removed then a continuity sensor is being used. If an external short is present in the machine from pins 2 to 1 of 4-pin connector 12, the External Sensors connector, then current will flow from resistor R11 through the external short and back to ground. Hence, the voltage at the junction of R11 and R12 will be very low. This will rob transistor Q3 of its base drive and keep it turned off. If an interruption of the conduction path between pins 2 and 1 occurs, then the voltage at the junction of R11 and R12 will climb and transistor Q3 will turn on. This will pull the noninverting input of U2B to ground and trigger the Reset condition to remove power and signal from the bill validator and generate the alarm condition. Diode D7 is a clamp to prevent the base of Q3 from going more than a diode drop below ground. Continuity sensors can be provided by other means such as switches, reed switches and magnets, or actual wires.

An alarm can be added to the anti-salting module 1 to provide an acoustical indication of the resent state. Further, either an integral or external delay can be added to provide drive for an alarm, horn or siren. In addition, the techniques described above can be used to remove power from the coin mechanism, the bill validator, the vending machine dispensers, or other portions of the vending machine.

In summary, the present invention provides a method and apparatus for preventing fraud and minimizing damage to a vending machine from injected liquids. The anti-salting module 1 attaches to existing bill validators without requiring their disassembly, and without the need for special hardware. Further, the cables from the coin mechanism and bill validators connect directly to the module without requiring any modification. The design of the module 1 prevents tampering with the moisture sensor 4, and provides for easy clean-up and resetting of the vending machine after a salting attack occurs. Fraud is prevented by using latching relays to disconnect power, which relays continue to interrupt the power and control signals until service personnel clean the tray of moisture and depress a SET switch which is integral to the module. Damage to vending machine components is minimized by collecting fluid in the tray, and draining it away from the components.

While the present invention has been described in connection with a preferred embodiment, it should be understood that other embodiments may fall within the spirit and scope of the invention.

We claim:

1. An apparatus for connection to an internal component of a vending machine for preventing fraud and for minimizing damage to said internal component and to other vending machine components from injected liquids, comprising:

a housing which connects underneath the internal component;

mounting members attached to the housing which connect to the internal component;

a tray integral to the housing for collecting the injected liquids;

a moisture sensor located in the tray; and detection and control circuitry connected to the moisture sensor, wherein the circuitry operates to interrupt power and control signals to the vending machine components when the liquid is sensed.

2. The apparatus of claim 1, wherein the housing connects underneath a bill validator and operates to interrupt power and control signals to the bill validator when the liquid is sensed.

3. The apparatus of claim 2, further comprising:

a fillet connected to the rear of the bill validator for directing injected liquids to the tray.

4. The apparatus of claim 1, wherein the mounting members are comprised of fingers and clips, and wherein the housing can be attached without tools or additional hardware.

5. The apparatus of claim 1, further comprising:

a drain located in the tray.

6. The apparatus of claim 5, further comprising:

piping connected to the drain for directing fluids away from the internal component of the vending machine.

7. The apparatus of claim 1, further comprising:

a set switch connected to the detection and control circuitry which must be depressed to reconnect power and control signals.

8. The apparatus of claim 7 wherein the depression of the set switch will not reconnect the power and control signals to the vending machine if moisture is present in the tray.

9. The apparatus of claim 1, wherein the detection and control circuitry is integral to the housing and is located in an enclosed case underneath the tray.

10. The apparatus of claim 1, further comprising:

an LED which is illuminated when moisture is present.

11. The apparatus of claim 1, further comprising:

at least one external moisture sensor connected to the detection and control circuitry which operates to interrupt power and control signals when a liquid is sensed.

12. The apparatus of claim 11, wherein the external moisture sensor is located in a coin track of a coin mechanism.

13. The apparatus of claim 1, further comprising:

at least one continuity sensor and associated detection means for monitoring vending machine components, wherein the continuity sensor is connected to, and can activate, the moisture detection and control circuitry to interrupt power and control signals when an open circuit condition is sensed.

14. The apparatus of claim 1, wherein the control circuitry comprises latching relays for disconnecting power and control signals.

15. The apparatus of claim 1, wherein the housing is made of molded plastic.

16. The apparatus of claim 1, wherein the moisture sensor comprises two pieces of metal.

17. The apparatus of claim 1, wherein the detection and control circuitry comprises:

a connector for connection to a T-cable used to intercept power and control signals to and from the internal component of the vending machine;

a power supply connected to the connector;

a latching relay circuit connected to the connector and the power supply;

a set circuit and a reset circuit connected to the latching relay circuit;

a power up and power down detect circuit connected to the reset circuit; and a moisture detector circuit connected to the set and reset circuitry and to one or more sensors.

18. The apparatus of claim 17, wherein the set circuit further comprises:

a set switch which must be depressed to restore power and control signals to the vending machine.

19. The apparatus of claim 17, where the set circuit further comprises:

an LED for indicating when the liquid is present.

20. The apparatus of claim 17, wherein the moisture detector circuit has an adaptive comparator circuit which produces a signal to trigger the reset circuit only if a predetermined threshold voltage based on a prior quiescent voltage is reached.

21. The apparatus of claim 20, wherein the moisture detector circuit has a bias network connected to the adaptive comparator circuit which establishes a preset minimum threshold voltage, such that a signal is produced to trigger the reset circuit when the preset minimum threshold voltage is reached.

22. The apparatus of claim 17, wherein the moisture detection circuit further comprises at least one jumper for adjusting the sensitivity of operation of the moisture sensor.

23. An apparatus for connection to an internal component of a vending machine for preventing fraud and for minimizing damage from injected liquids, comprising:

a housing which connects underneath the internal component;

mounting members attached to the housing which connect to the internal component;

tray means for collecting liquids molded into the housing;

means for detecting moisture connected to the tray means; and means for interrupting power and control signals to the vending machine when the liquid is detected.

24. The apparatus of claim 23, wherein the means for detecting the liquid is a moisture sensor.

25. The apparatus of claim 23, wherein the means for interrupting power and control signals comprises moisture detection and control circuitry utilizing latching relays.

26. A method for preventing fraud and for minimizing damage from a liquid injected into a vending machine, comprising:

mounting a housing having mounting members, a tray, at least one moisture sensor and moisture detecting circuitry beneath an internal component of a vending machine, wherein the mounting members connect to the internal component;

collecting the injected liquid in the tray;

sensing the liquid with the moisture sensor;

generating a signal with the moisture detecting circuitry; and interrupting vending machine power and control signals to and from the internal component in response to the generated signal to functionally disable the vending machine.

27. The method of claim 26, further comprising:

draining liquid away from the vending machine components.

28. The method of claim 27, wherein liquid is drained away by using tubing connected to a drain located in the tray.

29. The method of claim 26, further comprising:

turning off power to the entire vending machine in response to the generated signal.

30. The method of claim 26, further comprising:

turning off power to a bill validator in response to the generated signal.

31. The method of claim 26, further comprising:

setting off an alarm in response to the generated signal.

32. The method of claim 26, further comprising:

lighting an LED to indicate the presence of liquid.

33. The method of claim 26, further comprising:

returning power and functionality to the vending machine only after moisture is no longer present and a SET switch is depressed.

34. The method of claim 26, further comprising:

adjusting the sensitivity of the moisture detection circuit.

35. The method of claim 26, further comprising:

automatically adjusting the moisture detection circuit to compensate for environmental conditions that affect the performance of the moisture sensor.

36. The method of claim 26, wherein vending machine power and control signals are interrupted by opening at least one set of latching relay contacts.

37. The method of claim 36, wherein the set of latching relays can be closed only after moisture is no longer present and a SET switch is depressed.

38. The method of claim 26, further comprising:

connecting a continuity sensor and a continuity detection circuit to the moisture detection circuit;

sensing an open circuit condition with the continuity sensor;

generating a continuity signal; and interrupting vending machine power and control signals in response to the continuity signal.

* * * * *

UNITED STATES PATENT AND TRADEMARK OFFICE

CERTIFICATE OF CORRECTION

PATENT NO. : 5,318,164

DATED : June 7, 1994

INVENTOR(S) : Barnes, et al

It is certified that error appears in the above-indentified patent and that said Letters Patent is hereby corrected as shown below:

On the title page, at [75] add --Elwood E. Barnes, Cochraneville;-- preceding "Thomas".

Column 4, line 66, please insert --1-- after "module".

Column 11, line 31, replace "resent" with --reset--.

Column 11, line 45, replace "validators" with --validator--.

Signed and Sealed this

First Day of August, 1995

*Attest:*

*Attesting Officer*

BRUCE LEHMAN

*Commissioner of Patents and Trademarks*